US009586705B2

(12) United States Patent
Raudat et al.

(10) Patent No.: US 9,586,705 B2
(45) Date of Patent: Mar. 7, 2017

(54) COORDINATED SOFT-TOUCH CASE PACKER

(71) Applicants: John L. Raudat, Kalispell, MT (US); Les Dennison, Kalispell, MT (US)

(72) Inventors: John L. Raudat, Kalispell, MT (US); Les Dennison, Kalispell, MT (US)

(73) Assignee: Commercial Machine Services, Inc., Kalispell, MT (US)

( * ) Notice: Subject to any disclaimer, the term of this patent is extended or adjusted under 35 U.S.C. 154(b) by 669 days.

(21) Appl. No.: 13/843,677

(22) Filed: Mar. 15, 2013

(65) Prior Publication Data

US 2014/0059976 A1 Mar. 6, 2014

Related U.S. Application Data

(60) Provisional application No. 61/621,442, filed on Apr. 6, 2012.

(51) Int. Cl.

| | |
|---|---|
| ***B65B 5/06*** | (2006.01) |
| ***B65B 21/18*** | (2006.01) |
| ***B65B 39/00*** | (2006.01) |
| *B65B 21/02* | (2006.01) |
| *B65B 21/16* | (2006.01) |
| *B65B 21/14* | (2006.01) |
| *B65B 21/06* | (2006.01) |
| *B65B 21/00* | (2006.01) |
| *B65B 21/04* | (2006.01) |

(52) U.S. Cl.

CPC ..... *B65B 5/06* (2013.01); *B65B 21/18* (2013.01); *B65B 39/006* (2013.01); *B65B 21/00* (2013.01); *B65B 21/02* (2013.01); *B65B 21/04* (2013.01); *B65B 21/06* (2013.01); *B65B 21/14* (2013.01); *B65B 21/16* (2013.01)

(58) Field of Classification Search

None

See application file for complete search history.

(56) References Cited

U.S. PATENT DOCUMENTS

| | | | |
|---|---|---|---|
| 2,921,425 | A | 3/1958 | Seval |
| 3,353,331 | A | 11/1967 | Rowekamp |
| 3,561,189 | A | 2/1971 | Raudat |
| 3,589,094 | A | 6/1971 | Pearson |
| 3,648,427 | A | 3/1972 | Raudat |
| 3,744,213 | A | 7/1973 | Pearson |
| 3,832,826 | A | 9/1974 | Ullman |
| 4,075,819 | A | 2/1978 | Raudat et al. |
| 4,448,009 | A | 5/1984 | Raudat |
| 4,457,121 | A | 7/1984 | Johnson et al. |

(Continued)

*Primary Examiner* — Hemant M Desai
*Assistant Examiner* — Mobeen Ahmed
(74) *Attorney, Agent, or Firm* — Law Office of Craig Bohn; Craig E. Bohn

(57) ABSTRACT

Disclosed is a product case packing system with a gripping head assembly and a packaging grid assembly linked by a coordination arm that synchronizes the delivery of the product to be packaged and with the positioning of the grid assembly into the packaging container. The system includes a gripper head assembly extension control module, capable of controlling multiple travel distances of the gripper head assembly in a single packing cycle, a product assembly detection module, and a packaging release control element for subtle separation of individual packed containers.

5 Claims, 13 Drawing Sheets

(56) References Cited

U.S. PATENT DOCUMENTS

| | | | | |
|---|---|---|---|---|
| 4,569,181 | A | 2/1986 | Raudat | |
| 4,637,509 | A | 1/1987 | Raudat et al. | |
| 7,552,570 | B2 | 6/2009 | Raudat et al. | |
| 2004/0068956 | A1* | 4/2004 | Hartness | B65B 21/183 53/247 |

* cited by examiner

COORDINATED SOFT-TOUCH CASE PACKER

CROSS-REFERENCE TO RELATED APPLICATIONS

This application claims the benefit of provisional patent application No. 61/621,442, filed 6 Apr. 2012 by the present inventors, J. Raudat and L. Dennison.

STATEMENT REGARDING FEDERALLY SPONSORED RESEARCH OR DEVELOPMENT

Not Applicable

BACKGROUND OF THE INVENTION

This invention relates generally to automated packaging machines, and, more particularly, this invention relates to improvements of a coordinated movement of the gripper and grid sections for automatically packaging of groupings of distinct product items.

The field of automated packaging addresses the process of combining multiple distinct product units into a bulk container, to aid in storage and transportation for distribution, in a variety of ways. One common automated packaging machine may be seen to divide up the product and drop it into a box or case. Another machine stages the product as it flows, and captures a grouping of the product to relocate that grouping of product into the packaging box, or other suitable item, such as a carton, container, case, tray, or shell. These types of packaging machines can be seen to consist of a product feed section, a carton feed section, a load section, and an operator interface section. A quantity of product suitable for the capacity of a particular carton may be enough product to fill the carton, or enough to fill multiple cartons, or enough to fill a carton with multiple cycles of the packaging machine.

The operator interface section controls the system and allows the operator to manage the operation of the machine. It typically consists of a series of pushbuttons activators, along with read-out lights or displays, which enable the operator to start, stop, or alter the performance of the machine, and locate/correct any fault conditions.

The product feed section of the packaging machine includes a conveyor belt that transfers the product generally from an up stream process such as filling or labeling to the load section of the machine. The conveyor belt urges the product into lanes that align the product into a plurality of rows, and into the load section.

While the feed section fills the load section with product, the case feed section delivers empty boxes, cartons, or cases to the lift section via a conveyor. U.S. Pat. No. 3,353,331 issued to Rowekamp on 21 Nov. 1967, U.S. Pat. No. 3,561,189 issued to Raudat on 9 Feb. 1971, U.S. Pat. No. 2,921,425 issued to Seval on 19 Jan. 1960, U.S. Pat. No. 3,589,094 issued to Pearson on 29 Jun. 1971, U.S. Pat. No. 3,744,213 issued to Pearson on 10 Jul. 1973, U.S. Pat. No. 3,832,826 issued to Ullman on 3 Sep. 1974, and U.S. Pat. No. 4,457,121 issued to Johnson and Raudat on 3 Jul. 1984, demonstrate that the prior art teaches a variety of ways to deliver the grouped individual products into the cartons, once they are in the load section. However, none of these systems achieve the simplicity and compact footprint of the current system.

BRIEF DESCRIPTION OF THE DRAWINGS

The invention will be explained in conjunction with an illustrative embodiment shown in the accompanying drawings, in which.

DESCRIPTION OF THE ILLUSTRATED EMBODIMENT

Figure 1:
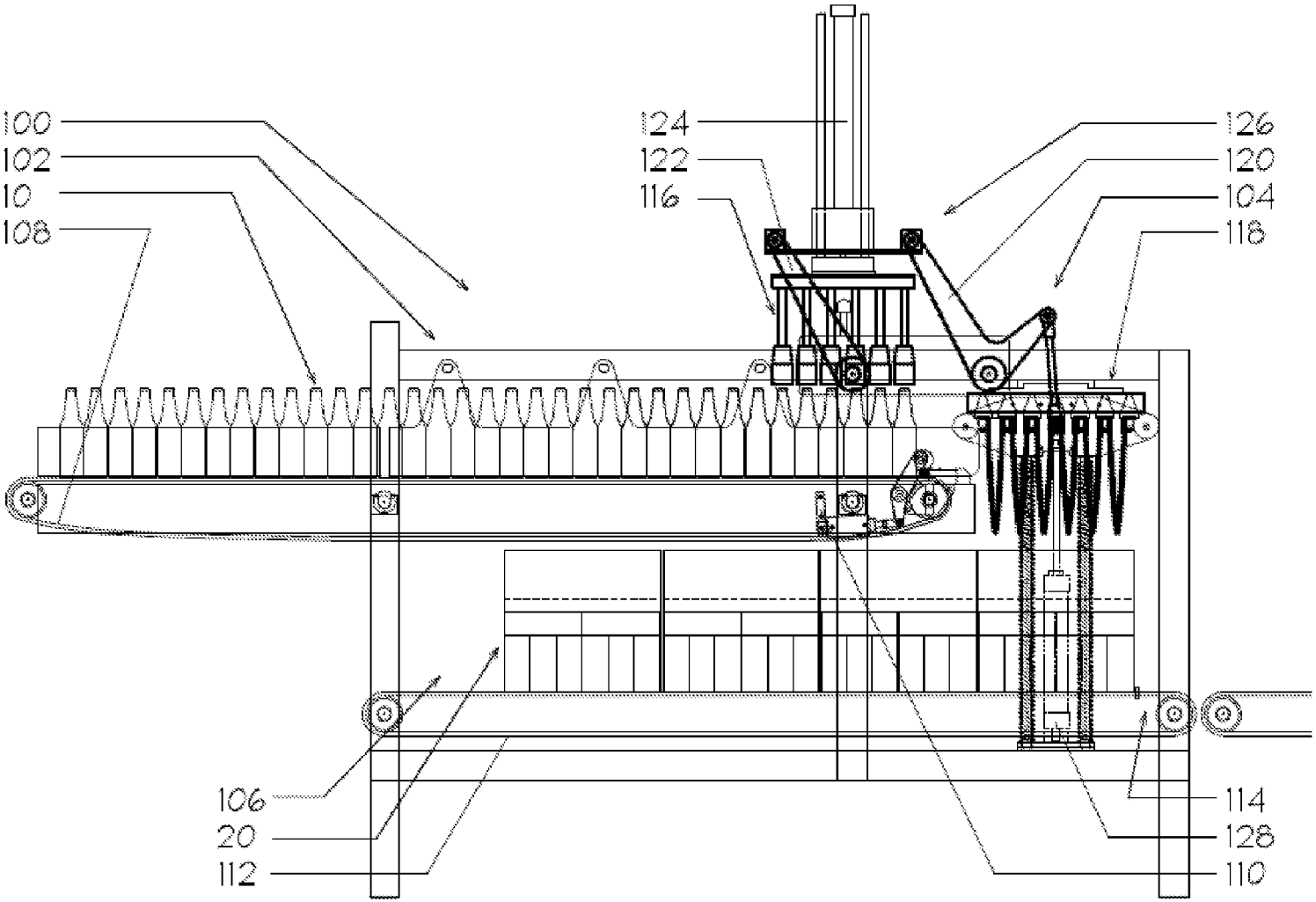
FIG. 1 is an elevation side view of an exemplary embodiment of a combined packing system, including a product feed section, a carton feed section, and a packing unit, of the current invention.

Now, referring to FIG. 1, the exemplary embodiment of the current packing system 100 is shown to comprise a product feed section 102, a packing unit 104, and a packaging feed section 106. The product feed section 102 is configured to assemble and position multiple distinct product units 10 into an orderly configuration for coordinated delivery into a bulk container. A product conveyor 108 transports the individual product units 10, also referred to as product, into a product assembly unit 110 that detects proper configuration and permits product units 10 to be conveyed by the packing unit 104. The packaging feed section 106 is configured to assemble and position multiple distinct carton units 20, also simply referred to as cartons, into an orderly configuration for receiving groupings of product units 10 from the packaging unit 104. A package conveyor 112 transports the cartons 20 into the carton management unit 114, where the cartons 20 receive the coordinated product units 10 from the packaging unit 104, and then are released to be assembled for bulk distribution.

The packing unit 104 transports the product 10 from the vicinity of the product assembly unit 110 to the cartons 20 positioned in the vicinity of the carton management unit 114. The exemplary packing unit 104 is comprises a gripper head assembly 116, a grid assembly 118, a coordination arm 120, three parallel arms 122, and a gripper head elevator 124. The gripper head assembly 116 and the gripper head elevator 124 are components of the exemplary pick-up assembly 126. The grid assembly 118 may also be simply referred to as the grid, and the gripper head elevator 124 may also be simply referred to as the elevator. The coordination arm 120 and the parallel arm 122 are shown on one side of the gripper head assembly 116. Each of the shown exemplary coordination arm 120 and the parallel arm 122 has a paired parallel arm on the opposite side of the gripper head assembly 116. The rigidity of the exemplary packing unit 104 permits the exemplary design to forego placing an additional coordination arm 120 on the opposite side. In the exemplary embodiment, the gripper head assembly 116 is supported by the coordination arm 120 and three parallel arms 122.

The exemplary packing unit 104 additionally comprises a coordination actuator 128 that affects the coordinated motion of the pick-up assembly 126 and the grid 118. The coordination actuator 128 functions to create coordinated motion through repeatable cycles, where in each full cycle a full carton 20 of product 10 is transported from the vicinity of the product assembly unit 110 to the carton 20 in the vicinity of the package management unit 114.

A suitable exemplary grid assembly 118 is described in U.S. Pat. No. 4,075,819, issued to John L. Raudat et al., on 28 Feb. 1978, and U.S. Pat. No. 4,448,009, issued to John L. Raudat (the current inventor), on 15 May 1984, which patents are both incorporated herein by reference to provide a detailed description of exemplary grid assemblies 118 and their function.

Figure 2:
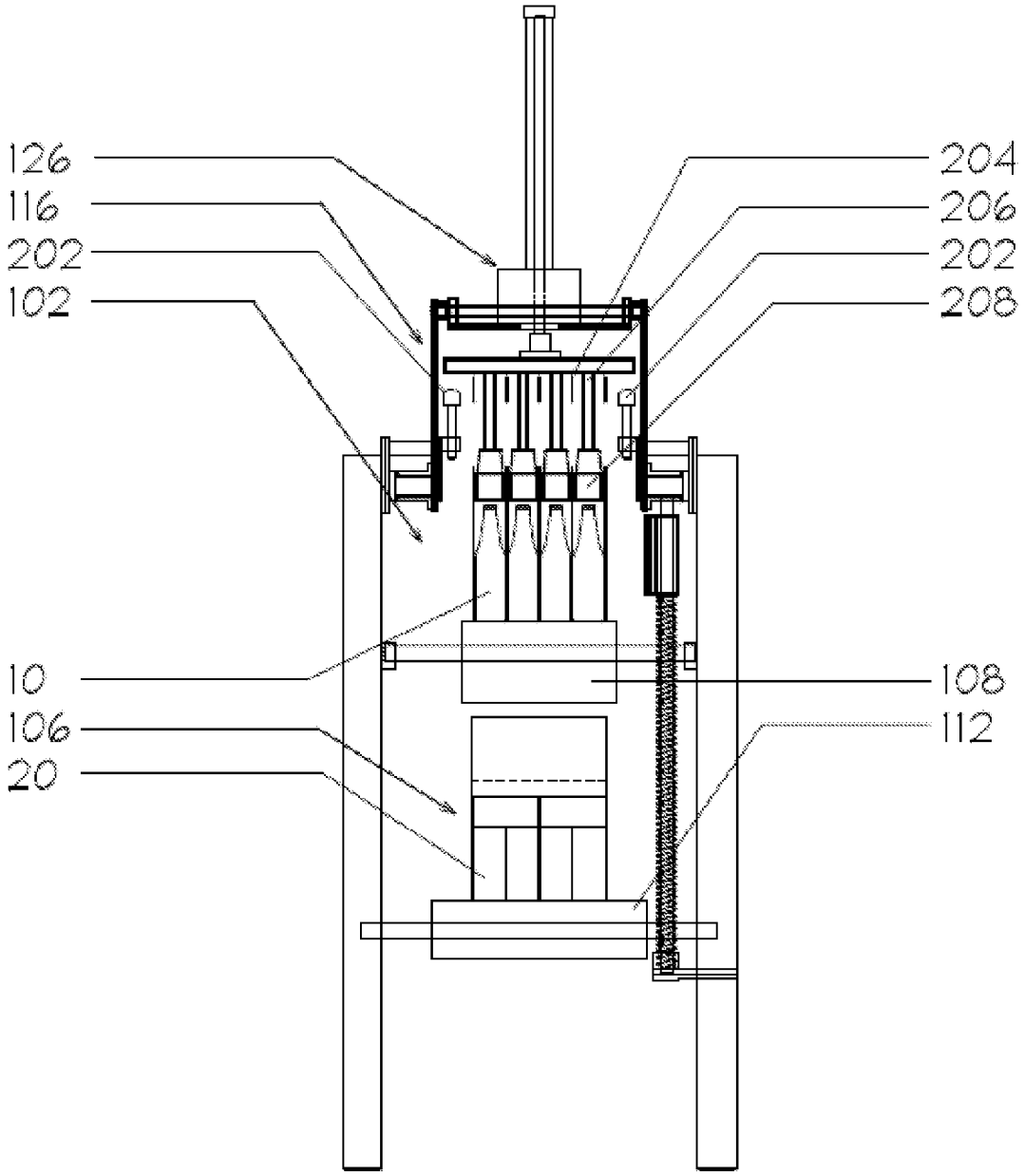
FIG. 2 is an elevation output-end view of the packing system of FIG. 1.

Referring now to FIG. 2, the exemplary packing system 100 has a lower stop 202 positioned in the vicinity of the product assembly unit 110. The lower stop 202 interrupts the full potential downward stroke of the gripper head elevator 124 at the precise level above the product 10. The elevator 124 has the potential for a long stroke, useful in delivering the product 10 into the carton 20. Separate short-stroke and long-stroke elevators may be employed as an alternative, but the lower stop 202 permits the use of a single elevator to facilitate both product 10 pick-up from the product assembly unit 110, and delivery to the carton 20 in vicinity of the package management unit 114. In the exemplary embodiment, packing system 100 has a right side and left side lower stop 202, in order to engage on two sides of the gripper plate 204, and more effectively distribute the forces at the stop point.

The exemplary gripper head assembly 116 comprises a gripper plate 204, gripper tubes 206, and grippers 208. In the exemplary embodiment there is a specific gripper tube 206 and gripper 208 for each product unit 10 to be picked up by the gripper head assembly 116 in each cycle. A suitable exemplary gripper head assembly 116 is described in U.S. Pat. No. 7,522,570, issued to John L. Raudat et al., on 30 Jun. 2009, which patent is incorporated herein by reference to provide a detailed description of an exemplary gripper head assembly 116 and its function. A suitable exemplary gripper 208 is described in U.S. Pat. No. 2,873,996, issued to Charles J. Mchugh et al., on 17 Feb. 1959, which patent is incorporated herein by reference to provide a detailed description of an exemplary gripper 208 and its function.

In the present exemplary embodiment, the gripper head assembly 116 is raised and lowered in a straight line by the elevator 124. When positioned in the vicinity of the product assembly unit 110, the downward stroke of the gripper head assembly 116 is interrupted by the gripper plate 204 contacting the lower stop 202. The exemplary lower stop 202 is designed to absorb the impact of the downward motion of the gripper head assembly 116. The exemplary lower stop 202 is a rigid steel rod, with a resilient elastomeric cap that contacts the gripper plate 204, and cushions the impact.

Figure 3:
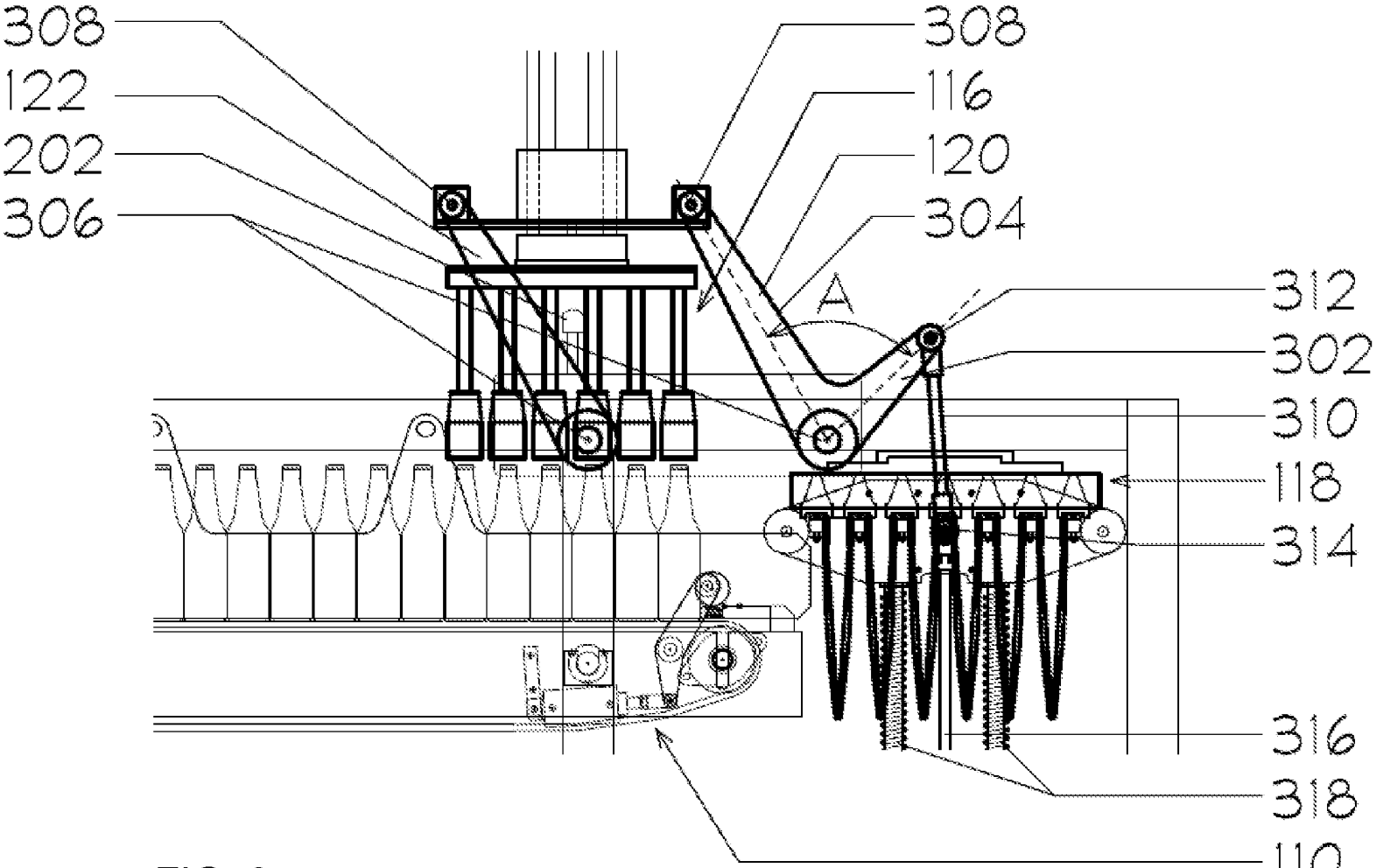
FIG. 3 is an elevation side view of the exemplary embodiment of the packing unit of the current invention depicted in FIG. 1.

Components of the exemplary packing unit 104 are shown in greater detail in FIG. 3. The exemplary coordination arm 120 is shown to have a lead arm 302 and a follow arm 304. The lead arm 302 is shorter than the follow arm 304, and measures slightly over half the length of the follow arm 304. The exemplary angle A between the centerline of the lead arm 302 and the follow arm 304 is 75 degrees, with angles from 70 degrees to 80 degrees believed to be operational. The coordination arm 120 and the parallel arms 122 are attached to the packing system 100 frame at frame pivot points 306, and to the pick-up assembly 126 at pick-up pivot 308. Frame pivot points 306 and pick-up pivot 308 for the coordination arm 120 and the parallel arms 122 are spaced an equal distance apart. Since the pick-up point may change as the characteristics of the particular product and carton vary, so the lengths of the lead arm 302, follow arm 304, and angle A can be adjusted to adapt to the particular product and carton dimensions.

The grid 118 is linked to the pick-up assembly 126 through rigid coordination arm 120 and grid link rod 310. Grid link rod 310 is attached to the lead arm 302 at link rod pivot 312, and the grid 118 at grid pivot 314. Grid link rod 310 is a rigid material that maintains a set distance between the link rod pivot 312 and the grid pivot 314, thereby coordinating the movement of the pick-up assembly 126 and the grid 118. By adapting the lengths of the lead arm 302 and the follow arm 304, as well as the grid link rod, other angles for angle A, between 85 degrees and 95 degrees, may be operational.

The grid 118 is attached to the coordination actuator 128 by grid drive rod 316, which also attaches to the grid 118 at grid pivot 314. Though grid drive rod 316 and grid link rod 310 both attach to grid 118 at grid pivot 314, they may be attached independently. Grid drive rod 316 is a rigid material that imparts motion directly from the coordination actuator 128 to the coordinated components of the pick-up assembly 126. In the exemplary embodiment, grid 118 travels along a part of the length of grid guides 318. Exemplary grid guides 318 are straight, parallel, rigid rods that are housed within compressible springs, so that the grid guides 318 direct the travel of the grid into a precisely positioned carton 20, and the springs assist the coordination actuator 128 to lift the grid 118 during part of the packing system 100 packing cycle.

Figure 4:
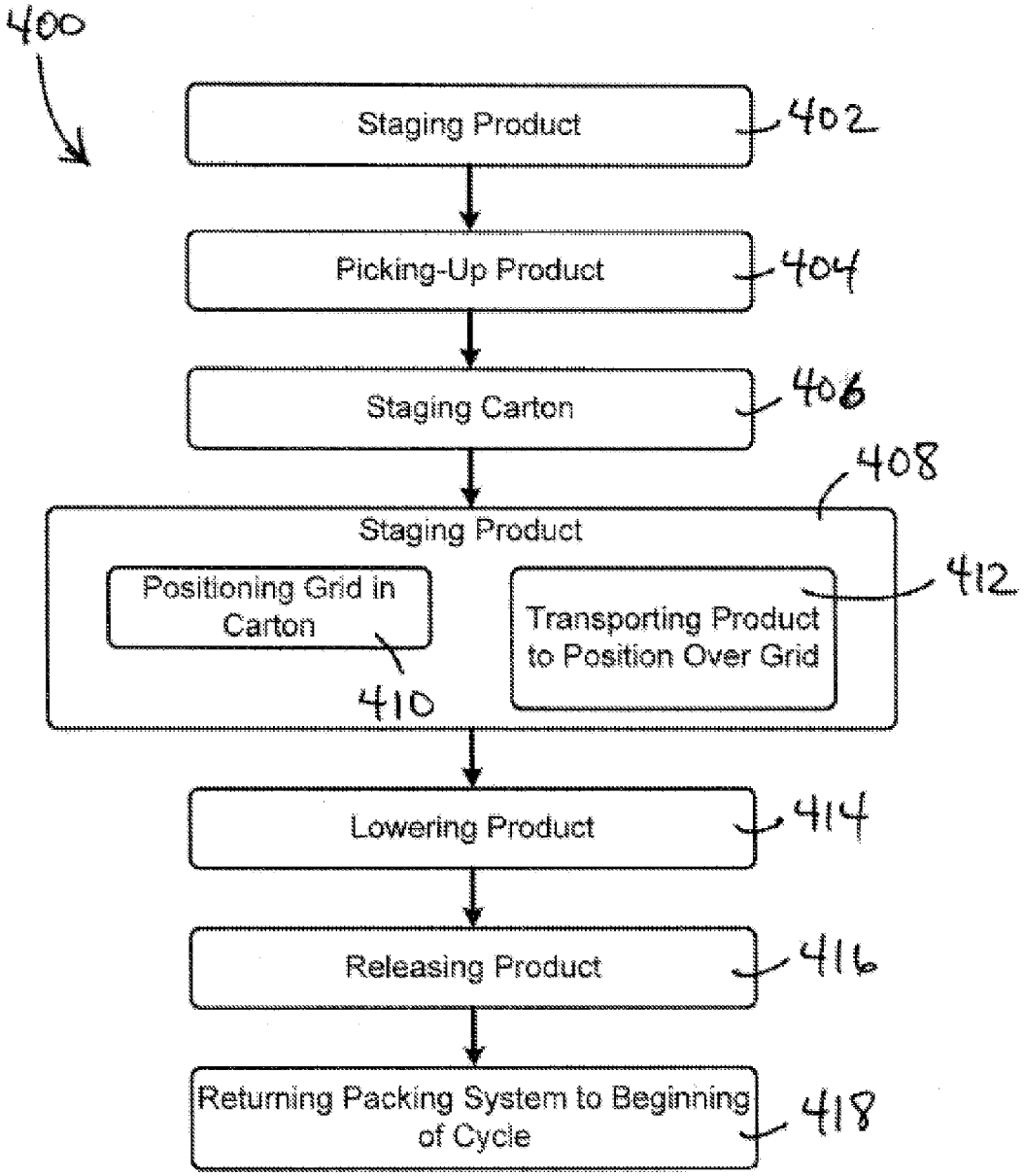
FIG. 4 is a flow diagram of the exemplary packing system operational process.
Figure 5:
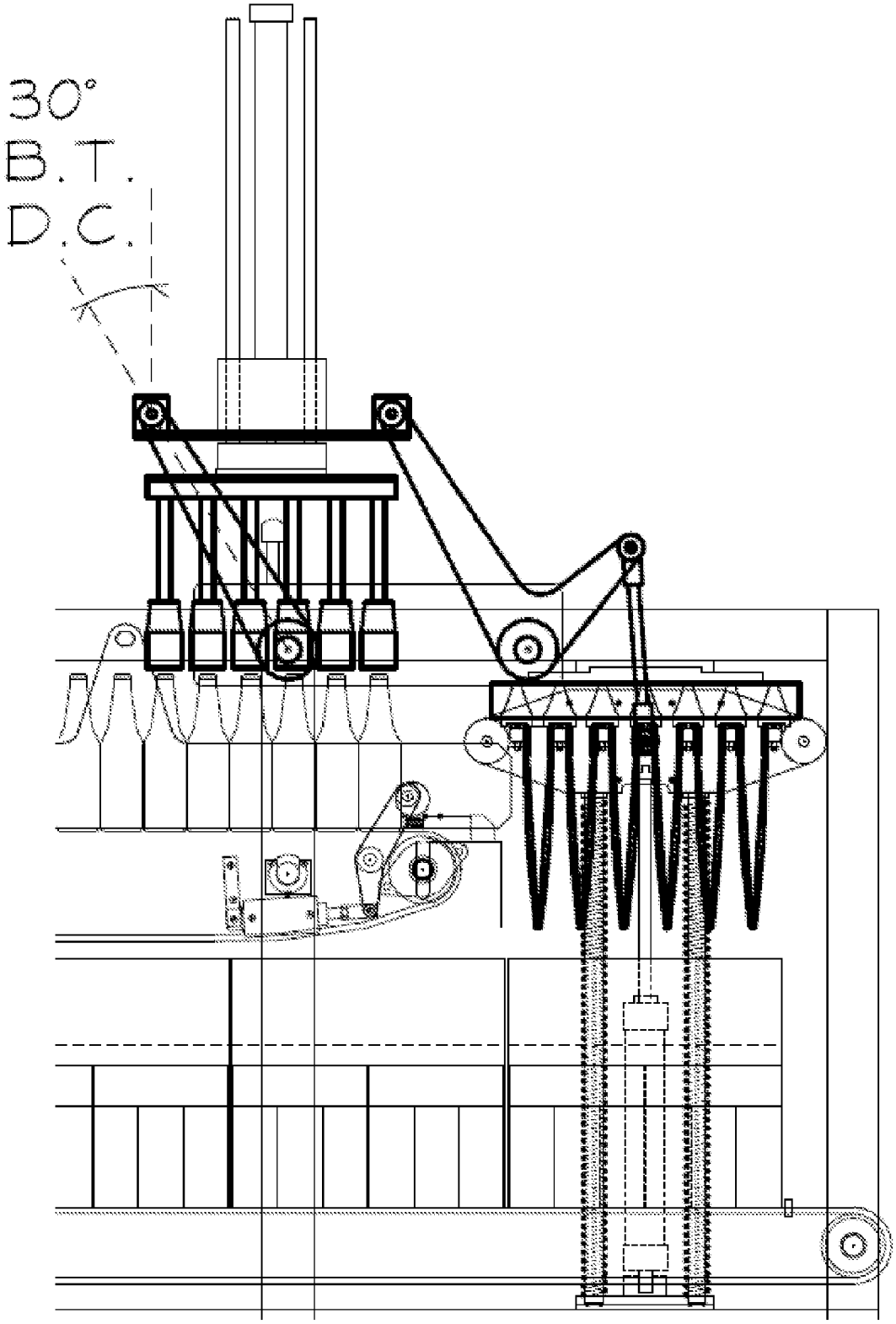
FIG. 5 is an elevation side view of the system depicted in FIG. 1, with the coordination arm positioned at 30-degrees before top dead center before product pick-up.
Figure 6:
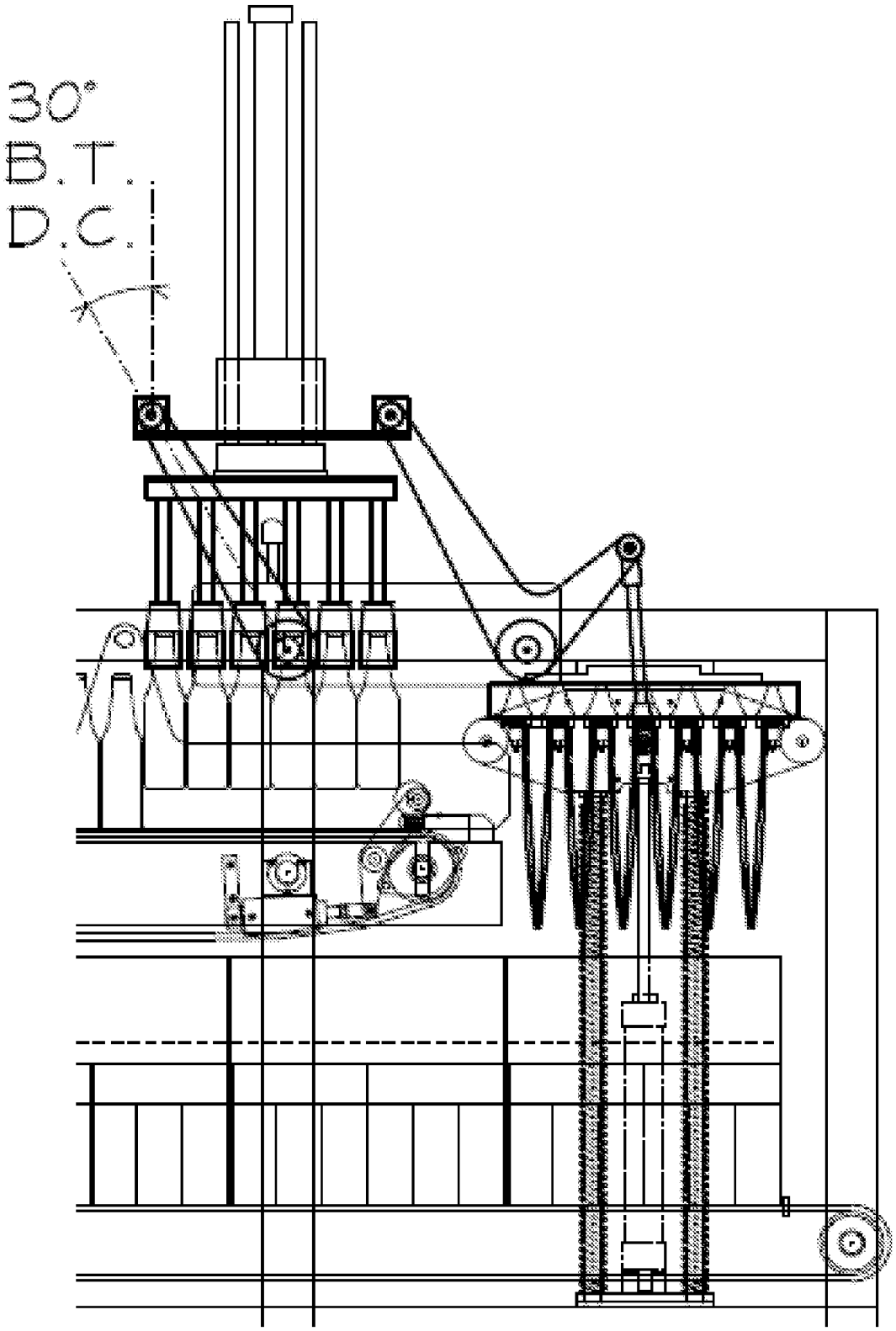
FIG. 6 is an elevation side view of the system depicted in FIG. 1, with the coordination arm positioned at 30-degrees before top dead center after product pick-up.
Figure 7:
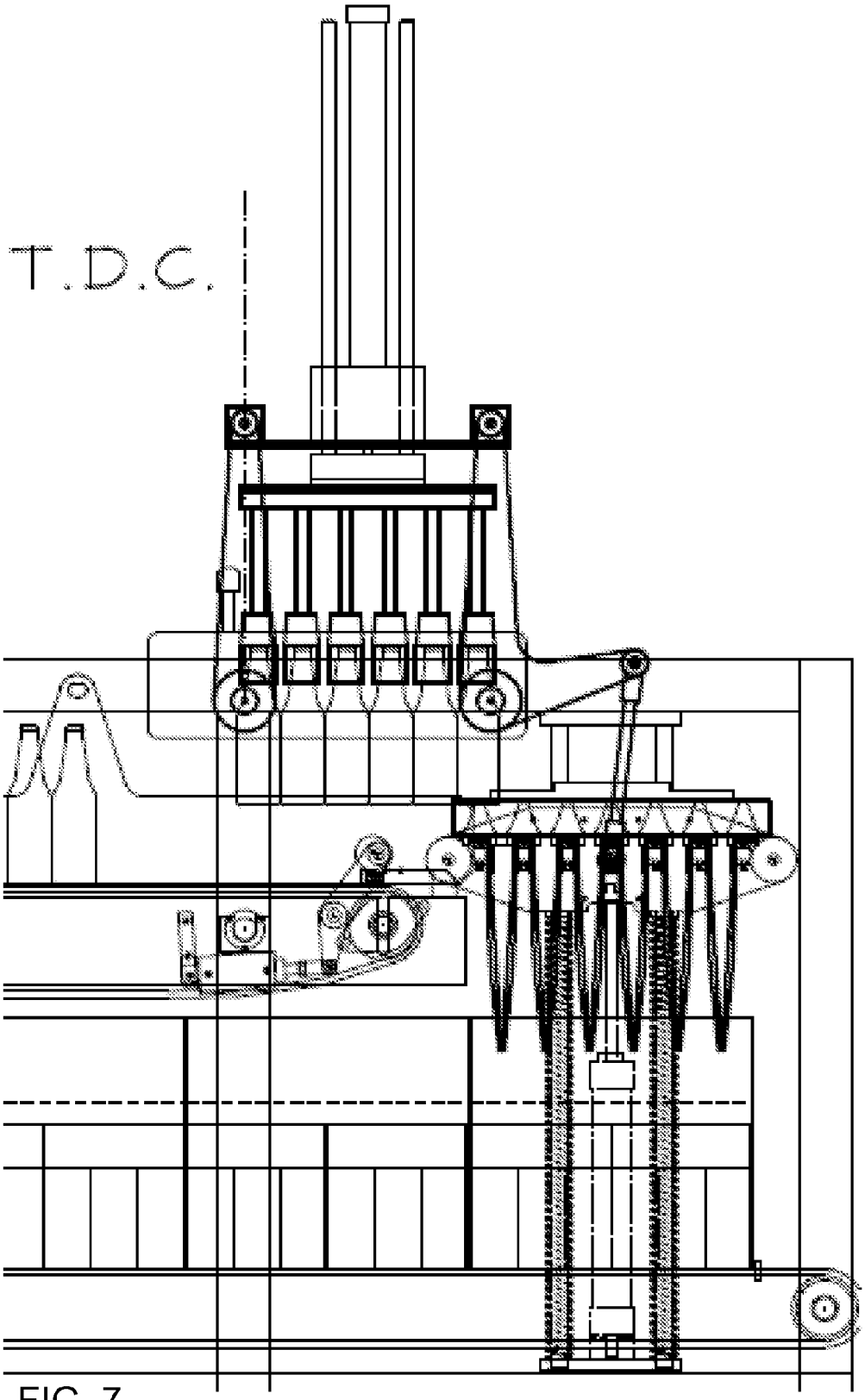
FIG. 7 is an elevation side view of the system depicted in FIG. 1, with the coordination arm positioned at 30-degrees before top dead center.
Figure 8:
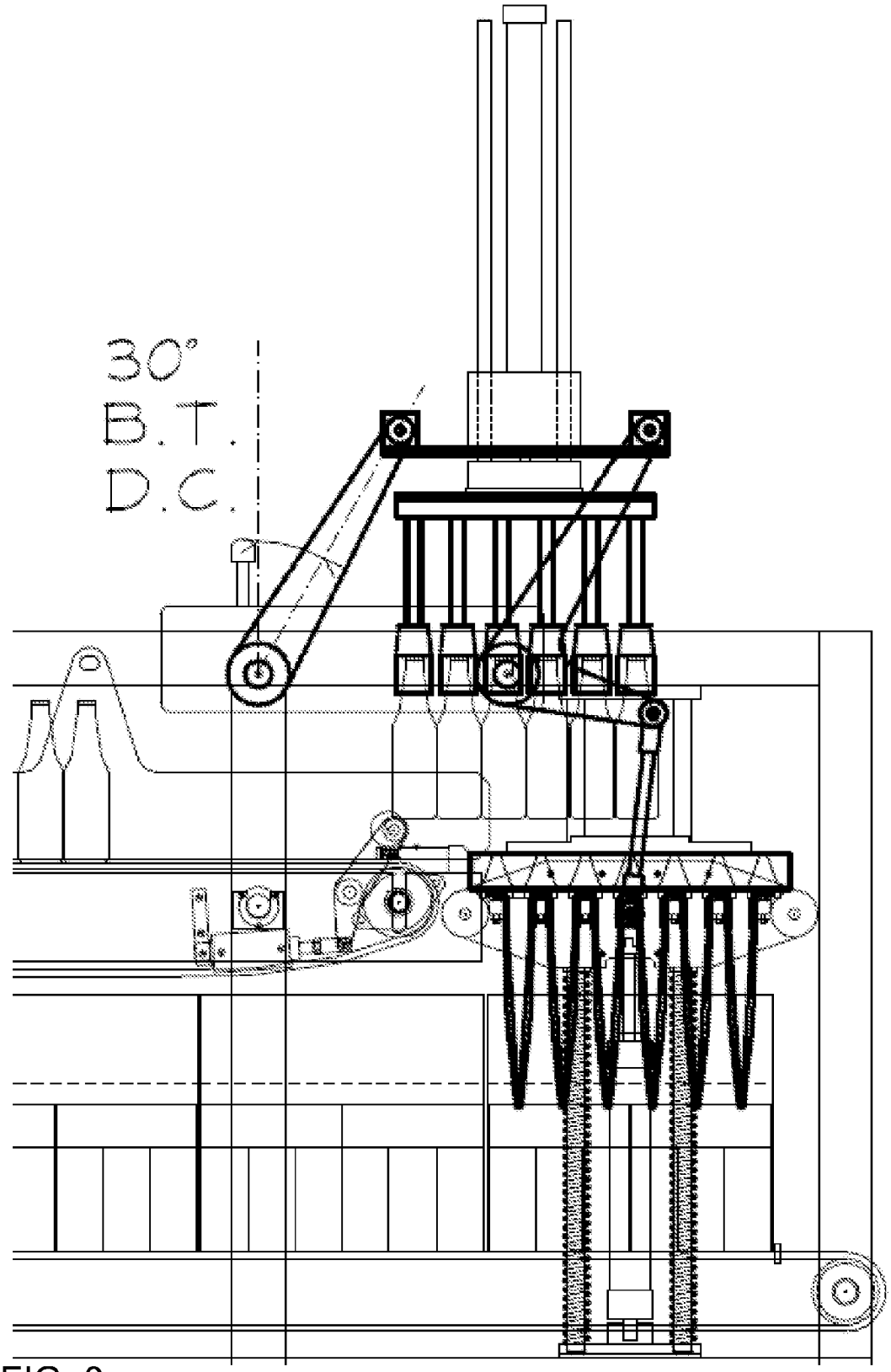
FIG. 8 is an elevation side view of the system depicted in FIG. 1, with the coordination arm positioned at 30-degrees after top dead center.
Figure 9:
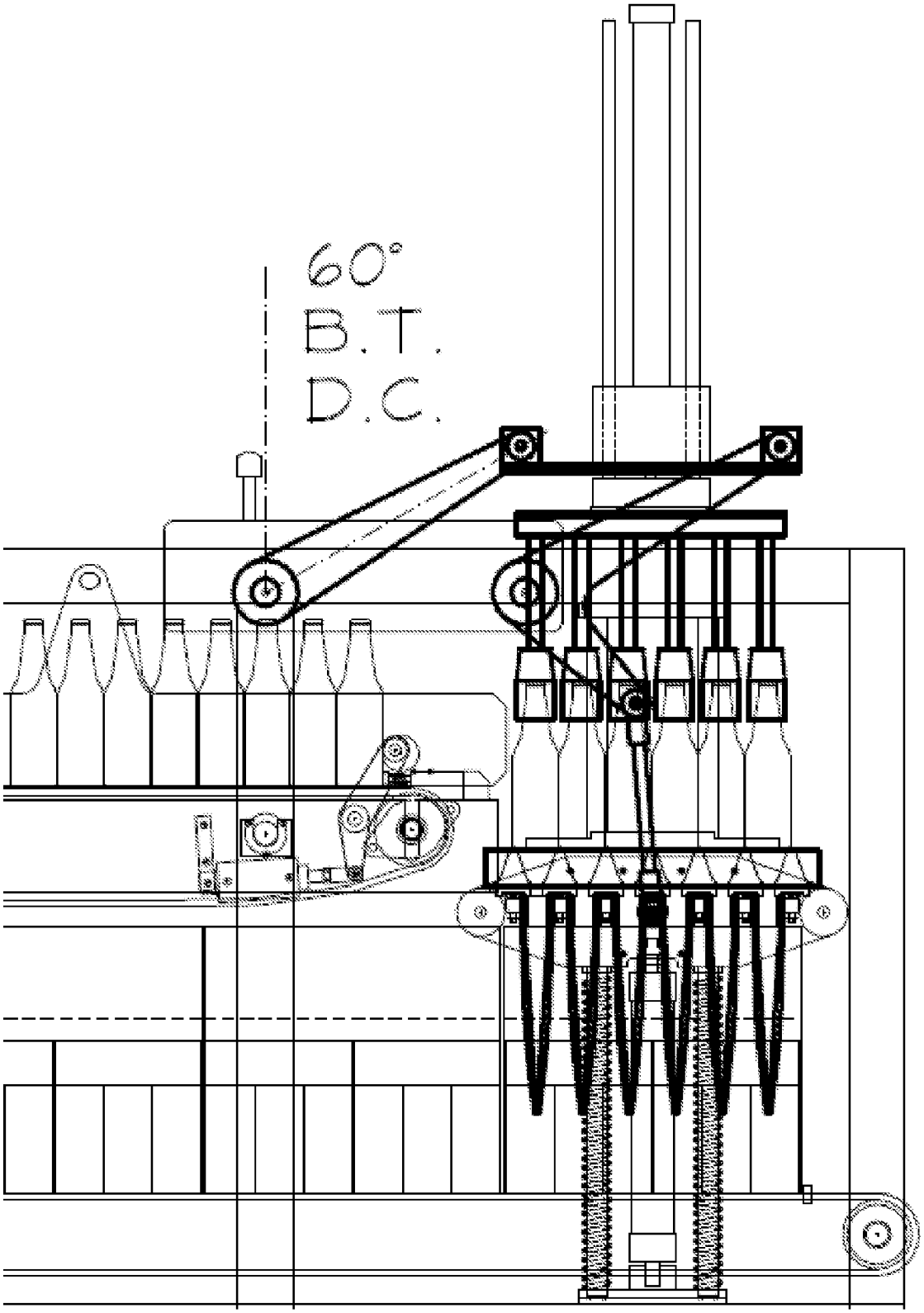
FIG. 9 is an elevation side view of the system depicted in FIG. 1, with the coordination arm positioned at 60-degrees after top dead center and the gripper head assembly raised while holding product.
Figure 10:
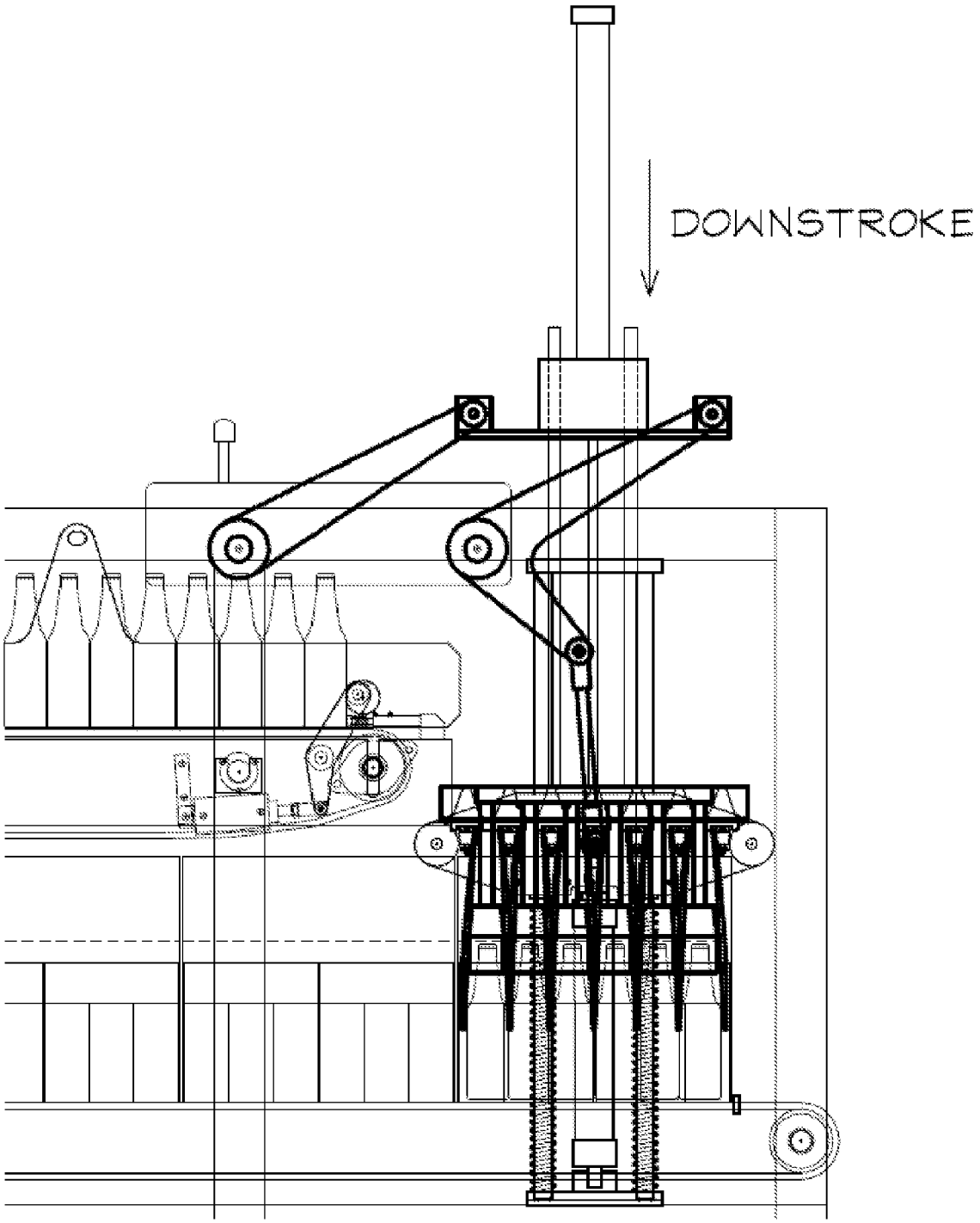
FIG. 10 is an elevation side view of the system depicted in FIG. 1, with the coordination arm positioned at 60-degrees after top dead center and the gripper head assembly lowered.
Figure 11:
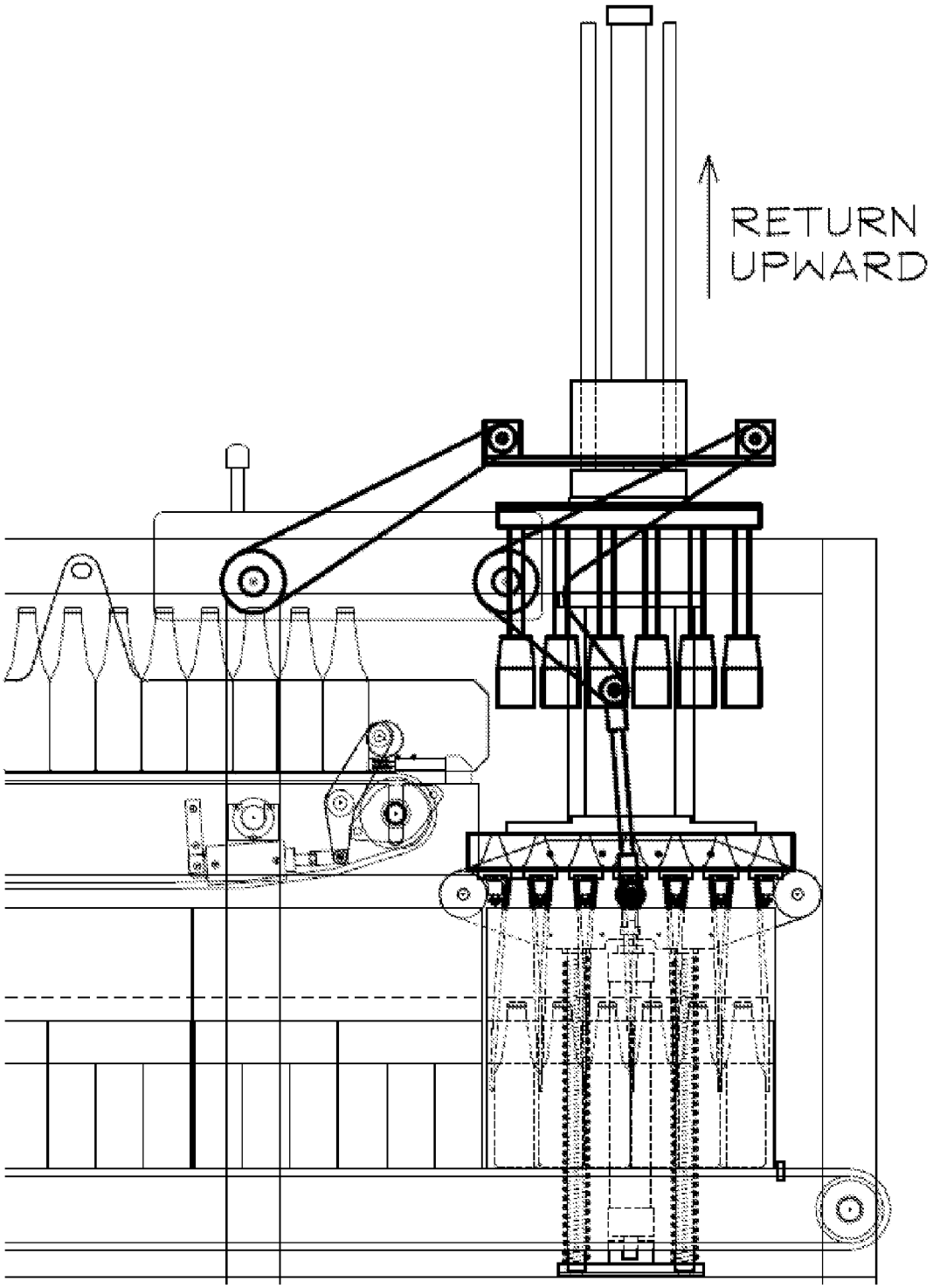
FIG. 11 is an elevation side view of the system depicted in FIG. 1, with the coordination arm positioned at 60-degrees after top dead center and the empty gripper head assembly raised.

Referring now to FIG. 4, the exemplary packing system 100 coordinatedly moves through a packing cycle 400, that has an infinite number of positions to accomplish the steps of 402 staging product 10, 404 picking up product 10, 406 staging a carton 20, 408 staging product, which in the exemplary embodiment includes simultaneously 410 positioning the grid 118 in the carton 20 and 412 transporting product 10 to a position over the grid 118, 414 lowering the product 10 to the grid 118, 416 releasing the product 10 through the grid 118, and 418 returning the packing system 100 to the beginning of the packing cycle 400 to pick up another grouping of product 10 and repeat the process as appropriate.

Referring now also to FIGS. 5 through 11, the exemplary cycle 400 starts with product appropriately positioned by the product assembly unit 110, and the gripper head assembly 116 in a raised position. The position of the coordination arm 120 in this example is referenced from the relative position of the pick-up pivot 308 of the follow arm 304 with respect to its path of travel in an arc around its frame pivot point 306. So referenced, exemplary step 404, picking-up product, is accomplished at 30 degrees before top dead center ("TDC").

Step 404, picking-up product, is accomplished by elevator 124 lowering gripper head assembly 116 until the gripper plate 204 rests on the lower stop 202. At this point grippers 208 are each positioned over a product 10, and an air supply is applied to the interior bladder of gripper 208 through gripper tube 206, holding each product 10 in a respective gripper 208 firmly enough to affect the lifting and transport of the product 10. Lifting is affected by elevator 124, while transporting is affected by coordination actuator 128, which rotates coordination arm 120 around its frame pivot point 306 through the linkage of the grid drive rod 316, to the grid 118, to the grid link rod 310, to the coordination arm 120.

While the gripper head assembly 116 secures the product 10, the packaging feed section 106 performs step 406, staging a carton 20 in the vicinity of the package management unit 114. Once the carton 20 is in position, the packing system 100 may perform step 408, staging product, which includes step 410, positioning the grid 118 in the carton 20, and step 412, transporting product 10 to a position over the grid 118. Packing system 100 performs steps 410 and 412 simultaneously, because of the geometric linkage of the pick-up assembly 126 and the grid 118 through the coordination arm 120. Exemplary step 410 occurs as the coordination arm 120 rotates from 30 degrees before TDC, to TDC, to 30 degrees after TDC, and then to 60 degrees after TDC. During this rotation the grid 118, which is attached to the shorter lead arm 302, travels distance from a raised position above carton 20, to a lowered position within a carton 20. At the same time, exemplary step 412 occurs, since the coordination arm 120 links the grid 118 to the gripper head assembly 116. During the rotation the gripper head assembly 116, which is attached to the relatively longer follow arm 304, travels a distance greater than the grid 118, and moves from a position over the product assembly unit 110 to a position over the grid 118.

In the exemplary embodiment, at 60 degrees after TDC the grid 118 stops a short distance from the bottom of the carton 20. In this situation a short distance is a distance at which the grid 118 can controllably route the individual product 10 into the carton 20 from the gripper head assembly 116 without damage to the product 10 or carton 20. Additionally, at 60 degrees after TDC the gripper head assembly is directly over the grid, but at a slightly too great of a distance to safely deliver the product 10 through the grid 118.

In the exemplary embodiment, with the coordination arm 120 at 60 degrees after TDC, the packing system 100 performs step 414, lowing the product 10 to the grid 118 by activating elevator 124 to complete a full downstroke, uninterrupted by lower stop 202, which is only located on the frame over the product assembly unit 110. In this position, at 60 degrees after TDC, and the gripper head assembly 116 lowered to within an effective distance of the grid 118, the packing system 100 can perform step 416, releasing the product 10 through the grid 118, by releasing the vacuum applied to the product 10 through the gripper head assembly 116.

In step 418, the packing system 100 returns to the beginning of the packing cycle 400 to pick up another grouping of product 10. The packing system 100 returns the gripper head assembly 116 to a raised position by activating elevator 124 to its full upward stroke. Additionally, in the exemplary embodiment, coordination actuator 128 operates to push the grid 118 to its upward position, in turn driving the coordination arm 120 through the return arc from a position of 60 degrees after TDC, to 30 degrees TDC, to TDC, and on to 30 degrees before TDC, so that the pick-up assembly 126 is once again positioned over the product 10 assembled by the product assembly unit 110.

Figure 12:
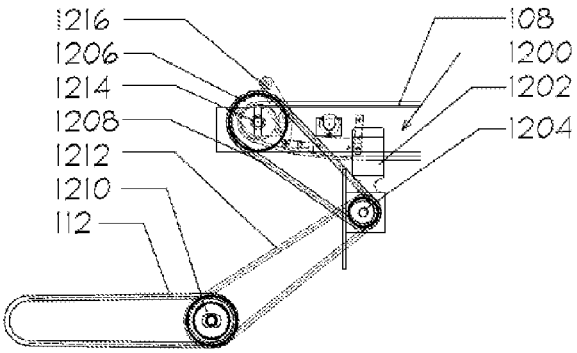
FIG. 12 is a perspective side view image of an exemplary dual-conveyor drive motor assembly.

Referring now to FIG. 12, an exemplary dual-conveyor drive motor assembly 1200. The exemplary embodiment has a motor sprocket 1204 capable of driving multiple drive belts. In the exemplary embodiment, motor sprocket 1204 is configured to drive product drive belt 1208, which in turn drives product sprocket 1206, and package drive belt 1212, which in turn drives package drive belt 1210. The exemplary product sprocket 1206 includes a selective drive mechanism 1214 capable of permitting the product sprocket 1206 to stop, while the product drive belt 1208 continues to move. An exemplary suitable selective drive mechanism 1214 may be clutch 1214, which may be controllably engaged and disengaged through a pressurized air supply used to control other components of the packaging system. Alternatively, the selective drive mechanism 1214 could be an electrically driven clutch. An assembly arm 1216 is shown in a raised position to restrain the product 10 in the vicinity of the product assembly unit 110. An exemplary product assembly unit 110 is shown and discussed in greater detail in FIGS. 18 through 20, below.

Figure 13:
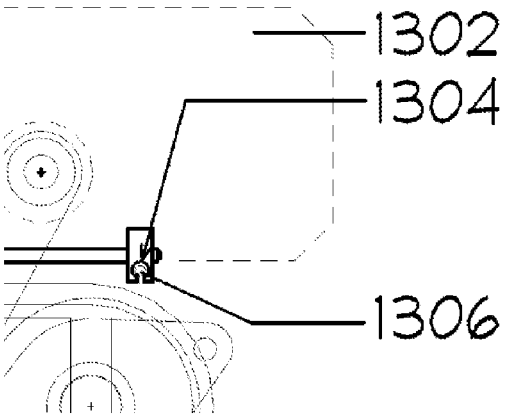
FIG. 13 is a perspective side view an exemplary product assembly sensor.
Figure 14:
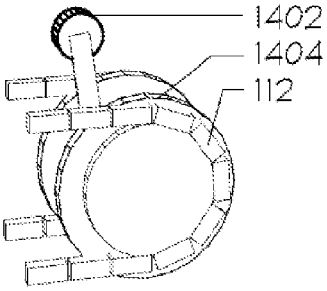
FIG. 14 is a perspective view image of an exemplary package management mechanism configured to assemble cartons.
Figure 15:
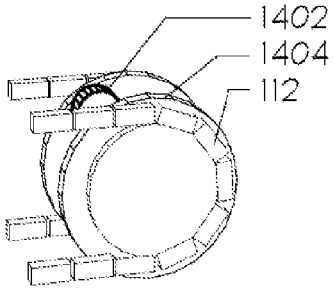
FIG. 15 is a perspective view image of an exemplary package management mechanism configured to release the carton.
Figure 16:
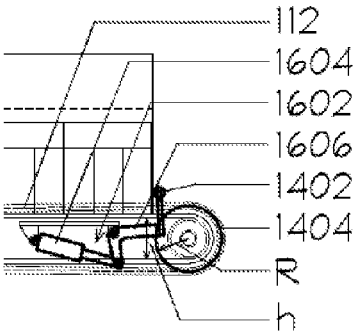
FIG. 16 is a perspective view image of an exemplary package management mechanism configured to assemble cartons.
Figure 17:
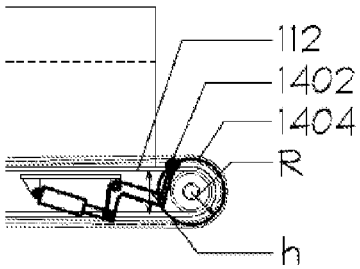
FIG. 17 is a perspective view image of an exemplary package management mechanism configured to release the carton.

Referring now to FIG. 13, an exemplary product assembly bumper 1302 includes individual components that sense the appropriate presence of product 10 in the vicinity of the product assembly unit 110. The exemplary product feed section 102 assembles the product 10 into individual lanes. A plurality of assembly bumpers 1302 may be arranged so that each lane has a bumper 1302. The exemplary bumpers 1302 are slightly spring loaded, to cause a bumper 1302 to move into a particular position when the respective product lane is filled with product 10. Each bumper 1302 includes a body through which is a formed a sight channel 1304. The exemplary embodiment employs a light source 1306 on one side of the bumper array, and sensor (not shown) on the other side of the array, to detect when the sight channels 1304 of the entire array of bumpers 1302 align, permitting the light source 1306 to shine light on the sensor (not shown).

Referring now to FIGS. 14 through 17, an exemplary package management unit 114 is shown to have a package stop 1402, which is part of a package stop assembly 1602. The exemplary package stop 1402 has a raised position, shown in FIGS. 14 and 16, and a lowered position, shown in FIGS. 15 and 17. Stop assembly 1602 may include a package stop 1402, a stop actuator 1604 and a stop arm 1606. The exemplary package stop 1402 is operatively attached to the stop actuator 1604 through stop arm 1606.

An additional component of the exemplary embodiments of FIGS. 14 through 17 is a kicker wheel 1404. Where the inside surfaces of the package conveyor 112, which doubles back against itself, are separated by a distance h, the exemplary kicker wheel 1404 has a radius R, which is greater than ½ h. The greater radius means that the surface of the kicker wheel 1404 is raised slightly above the outer surface of the package conveyor. Additionally, the greater radius means that the surface of the kicker wheel 1404 moves at a greater circumferential velocity than the package conveyor 112. The greater velocity results in giving a filled package 20, which has been released by the stop 1402, a slight boost of speed relative to the subsequent packages 20. The boost of speed creates separation, permitting the stop 1402 to be raised after the filled packages 20 passes, just in time to stop the next package 20 to be filled.

Figure 18:
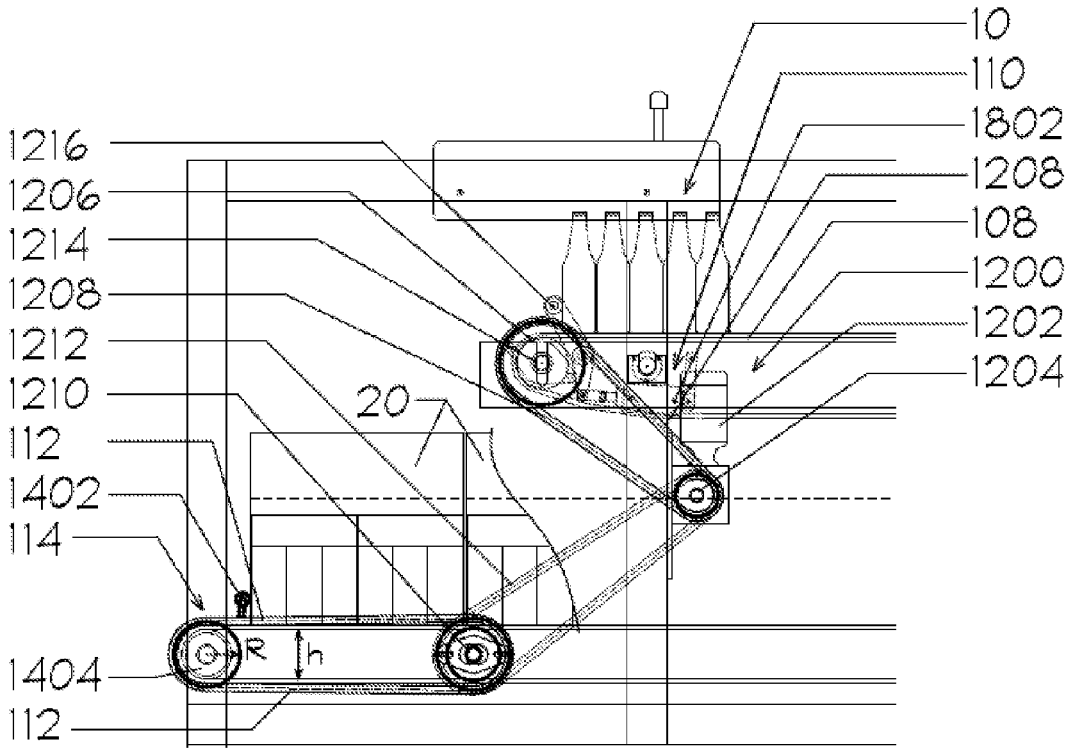
FIG. 18 is an elevation side view of an exemplary embodiment of a dual-conveyor drive motor system, coupled with a product feed section, and a carton feed section.
Figure 19:
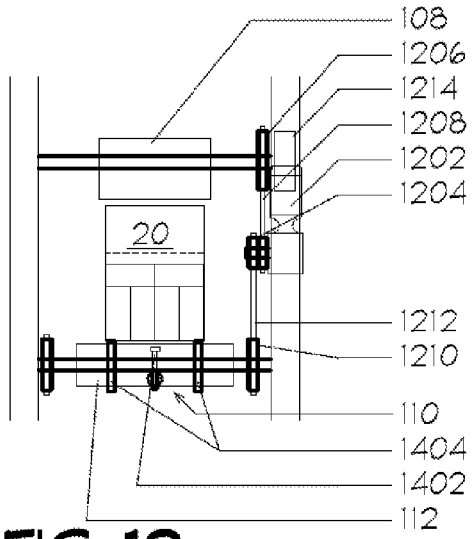
FIG. 19 is an elevation output-end view of the dual-conveyor drive motor system of FIG. 18.
Figure 20:
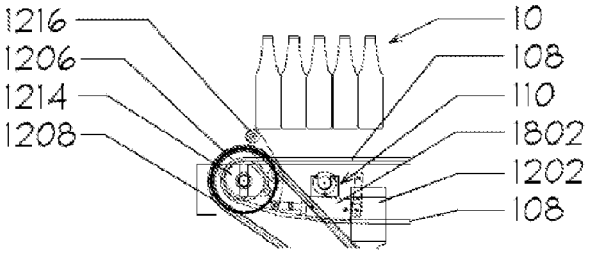
FIG. 20 is an elevation side view of the exemplary embodiment of the assembly unit of the current invention depicted in FIG. 18.

Referring now to FIGS. 18 through 20, an exemplary product assembly unit 110 assembles the product 10 for pick-up by the pick-up assembly 126. An exemplary product sprocket 1206 is operatively attached to product conveyor 108 to effect movement of the product units 10 thereon. Though a limiter bar (not shown) spanning between assembly arms 1216 on each side of the product conveyor 108 may effectively inhibit product 10 from going off the end of the product feed section 102, the exemplary embodiment employs a selective drive mechanism 1214 to permit the product sprocket 1206 and product conveyor 108 to stop, while the drive motor 1202 continues to run to move packages 20 into position to fill, and on after being filled.

In operation, the product conveyor 108 moves product 10 into position to be picked-up by the pick-up assembly 126, while the package conveyor 112 moves packages 20 into position to be filled by the pick-up assembly 126. When each lane of product 10 is appropriately filled with product 10, the array of bumpers 1302 permit the light source 1306 to activate the sensor (not shown), which in turn engages the clutch 1214, stopping the movement of the product conveyor 108. With the product conveyor stopped, the product assembly unit 110 can lower the assembly arms 1216 with assembly actuator 1802. Lowering assembly arms 1216 lowers the attached limiter bar (not shown), so that product 10, lifted by the pick-up assembly 126, can clear the limiter bar without requiring greater lifting from the product conveyor 108. Lowering the limiter bar additionally permits step 408, staging product, which includes step 412, transporting product 10 to a position over the grid 118, to more rapidly follow step 404, picking-up product, since the product 10 need only be lifted a short distance to clear the lowered limiter bar.

In the exemplary embodiment, the sensor attached to the bumpers 1302 engages the clutch 1214, but does not disengage the clutch 1214, since it would do so as soon as the product 10 is lifted from the product conveyor 108, if not when the product conveyor 108 stops. A subsequent sensor disengages the clutch 1214 and starts the product conveyor 108 once the step 412, transporting product 10 to a position over the grid 118, moves the product 10 being packed out of the way. The exemplary embodiment uses a sensor that detects a position of the coordination arm 120 or parallel arm 122 that indicates the product 10 being picked-up are out of the way of the incoming product 10.

Referring back to FIGS. 3, 12, 13, 18 and 20, exemplary step 404, picking-up product, is accomplished at 30 degrees before top dead center ("TDC"), but a range between 25 degrees and 35 degrees may be adaptably suitable. Initiating step 404 with coordination arm 120 at a slightly greater degree off TDC, for example 31 degrees or 32 degrees, up to 35 degrees, or even greater, will create a steeper angle of ascent of the product 10 off product conveyor 108, permitting the bottom of product 10 to more quickly clear the product assembly unit 110, specifically the limiter arm (not shown) that extends perpendicular across the product conveyor 108.

Various adjustments may then be made within the scope of the teachings of this disclosure to compensate for this additional angle during either or both lowering product step 414 and releasing product step 416. The exemplary initiation of staging the product step 408 occurs as the coordination arm 120 rotates from 30 degrees before TDC, to TDC, to 30 degrees after TDC, and then to 60 degrees after TDC. Ranges between 25 degrees and 35 degrees before and after TDC may be adaptably suitable, and ranges between 55 degrees and 65 degrees after TDC may be adaptably suitable. The range of the range of motion of the staging the product step 408 may be adjusted by the travel length of the stroke of the coordination actuator 128 and the length of both the grid drive rod 316 and the grid link rod 310. Any combination of a longer extension of the coordination actuator 128, grid drive rod 316 and the grid link rod 310 will expand the before TDC angle at the picking-up product step 404 and the initiation of staging product step 408. Any combination of a shorter extension of the coordination actuator 128, grid drive rod 316 and the grid link rod 310 will expand the after TDC angles at the end of the staging the product step 408. The total travel distance of coordination actuator 128 may be set to have staging product step 408 start at an angle of about 31 degrees or 32 degrees before TDC, and have staging product step 408 end at an angle of about 61 degrees or 62 degrees after TDC.

However, since angle A would remain the rigid the product 10 drop distance from when the product 10 is released from the gripper head assembly 116 until it is interfaces with grid assembly 118 to be controllably deposited into a carton 20, barring any other geometric changes, would remain the same. In an alternate exemplary embodiment, coordination arm 120 may be lockably hinged, permitting the infinite adjustment of the angle A.

The foregoing disclosure and description is illustrative and explanatory thereof. Any present invention should only be limited by the allowed claims and their legal equivalents. The allowed claims should be given their broadest interpretation, given the reasonable meanings of the words used herein, combined with the reasonable interpretation of one having ordinary skill in the art of automated packaging machines. The inventor trusts and relies on these legal principle, in order to avoid being unnecessarily repetitive and verbose. Various changes in the details of the illustrated construction may be made within the scope of the appended claims by one having ordinary skill in the art without departing from the spirit of the invention and scope of the claims.

We claim:

1. A coordinated motion packaging machine for packaging product assembled in a product feed section in a bulk package assembled in a carton feed section, the packaging machine comprising:

a gripper head assembly, a coordination arm, and a grid assembly;

the coordination arm having a lead arm, a follow arm, and a frame pivot point;

the lead arm operatively linked to the grid assembly, and the follow arm operatively linked to the gripper head assembly;

an angle at the frame pivot point between the lead arm and the follow arm is fixed;

the gripper head assembly capable of simultaneously lifting a plurality of product and transporting the plurality of product to a position over the grid assembly and the bulk package;

the grid assembly having fingers for guiding the product into the bulk package; and the coordination arm linking motion of the grid assembly to simultaneous motion of the gripper head assembly.

2. The packaging machine of claim 1, further comprising:

the angle at the frame pivot point between the lead arm and the follow arm is 75 degrees.

3. The packaging machine of claim 1, further comprising:

the angle at the frame pivot point between the lead arm and the follow arm is between 70 and 80 degrees.

4. The packaging machine of claim 1, further comprising:

the frame pivot point comprising a lockable hinge; and the angle at the frame pivot point between the lead arm and the follow arm is adjustably fixed.

5. The packaging machine of claim 1, further comprising:

the frame pivot point comprising a lockable hinge; and the angle at the frame pivot point between the lead arm and the follow arm is lockably adjustable.

* * * * *